United States Patent [19]

Maxey

[11] 4,086,065

[45] Apr. 25, 1978

[54] METHOD OF RIGIDIFYING WORK REST BLADE FOR CENTERLESS GRINDER

[76] Inventor: Van Q. Maxey, 17765 Casa La., Morgan Hill, Calif. 95037

[21] Appl. No.: 820,102

[22] Filed: Jul. 29, 1977

Related U.S. Application Data

[62] Division of Ser. No. 611,651, Sep. 9, 1975.

[51] Int. Cl.[2] ..... B23P 11/02

[52] U.S. Cl. ..... 29/446; 51/238 GG

[58] Field of Search ..... 29/446; 51/238, 236, 51/237, 165 R, 219 PC; 64/1 S, 9 R

[56] References Cited

U.S. PATENT DOCUMENTS

| | | | |
|---|---|---|---|
| 1,393,046 | 10/1921 | Singer | 51/238 GG |
| 1,691,061 | 11/1928 | Heim | 51/238 GG |
| 2,380,952 | 6/1943 | Dewey | 61/1 S |
| 2,469,353 | 9/1969 | Klein | 51/49 |
| 2,863,263 | 12/1958 | Perkes | 51/238 GG |
| 3,105,413 | 10/1963 | Lanzenberger | 51/165 R |
| 3,469,353 | 9/1969 | Klein | 51/49 |
| 3,890,803 | 6/1975 | Neal | 64/9 R |
| 3,899,270 | 8/1975 | Swedberg | 64/9 R |

FOREIGN PATENT DOCUMENTS

| | | | |
|---|---|---|---|
| 1,036,838 | 4/1951 | France | 64/1 S |

*Primary Examiner*—Harold D. Whitehead
*Attorney, Agent, or Firm*—John J. Leavitt

[57] ABSTRACT

A work rest blade assembly for a centerless grinder that provides multiple wear surfaces on which a work piece may be supported. The work rest blade assembly includes a generally cylindrical work rest bar splined at opposite ends and clamped to a crowned support plate in such a manner that the bar is flexed from end to end to impose a bending moment thereon and is twisted in opposite directions at opposite ends so as to impose a rotary moment on the bar to thus rigidify it.

2 Claims, 16 Drawing Figures

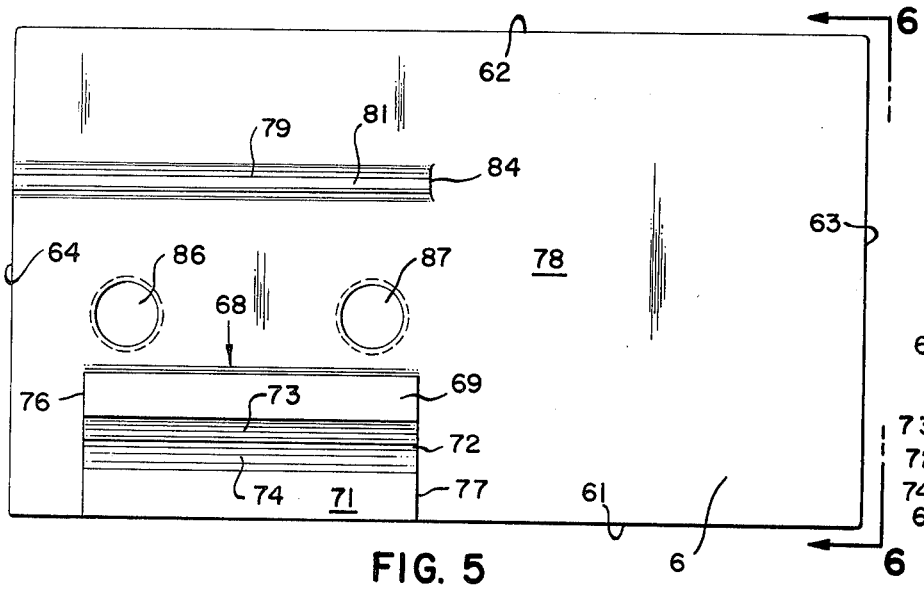
FIG. 5
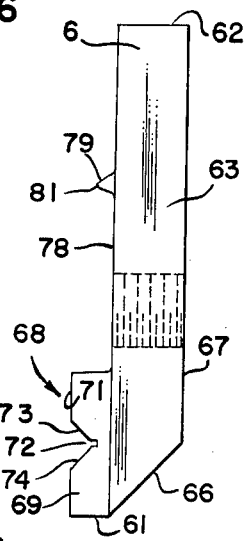
FIG. 6
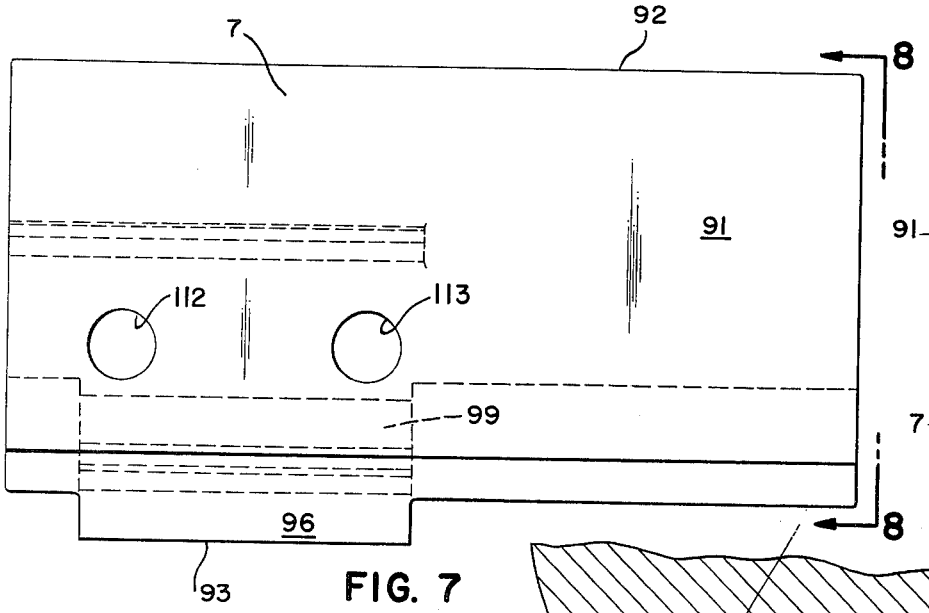
FIG. 7
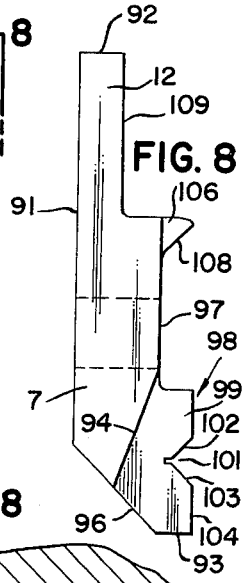
FIG. 8
FIG. 15
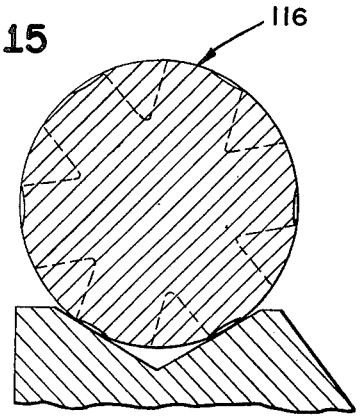
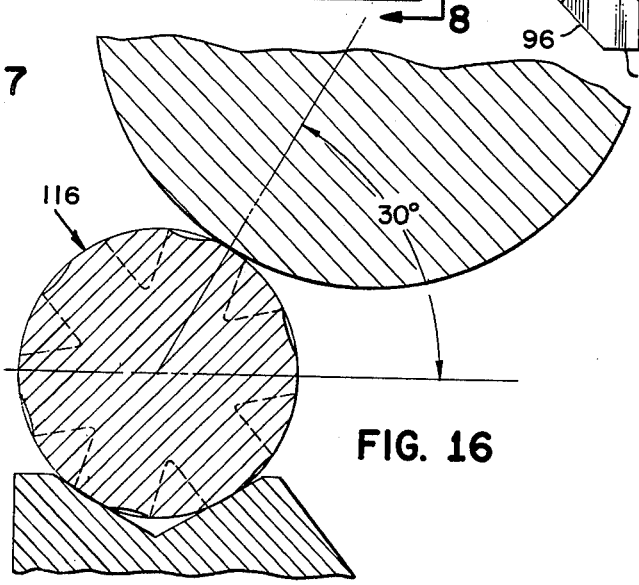
FIG. 16

METHOD OF RIGIDIFYING WORK REST BLADE FOR CENTERLESS GRINDER

This is a division of application Ser. No. 611,651 filed Sept. 9, 1975.

BACKGROUND OF THE INVENTION

This invention relates to centerless grinders, and more particularly relates to what is conventionally called the work rest or work rest assembly or work rest blade associated with centerless grinders and on which the work piece to be ground is supported during the grinding operation. Conventional centerless grinders incorporate a work rest blade assembly that includes a bar having a single surface on which the work piece is supported. Understandably, since a centerless grinder functions to grind off particles from the work piece being polished or ground, particles of the work piece and in many cases particles of the grinding wheels form a dust that collects between the work piece and the bar on which it is supported. Since such particles or dust is abrasive, and since the work piece is rotating in relation to the grinding wheels and in relation to the supporting bar, conventional work support bars have a very limited life. Accordingly, it is one of the objects of the present invention to provide a work rest blade assembly that may be used from four to six or more times as long as a conventional work support bar.

A centerless grinder functions to provide extremely accurate and highly polished surfaces on cylindrical objects. The accuracy with which the grinding is accomplished depends in large measure upon the condition of the grinding wheels and the work rest blade assembly associated therewith. In most instances, the accuracy with which a grinding operation is performed on a centerless grinder is dependent upon the competency of the individual operator. Since conventional work support bars in work rest blade assemblies wear rapidly because of the abrasive nature of the operation, a skilled operator must carefully reposition or adjust the work rest blade assembly and the work support bar carried thereby as grinding proceeds so as to compensate for any wear that might occur on the work support bar. The necessity for such adjustments introduces the possibility of inaccuracies which are reflected in the work piece. Accordingly, it is another object of the present invention to provide a work rest blade assembly including a work support bar which provides a multiplicity of unworn work support surfaces on which the work piece may be supported.

Another cause of inaccuracies in the grinding of a work piece in a centerless grinding machine is the tendency of the work support bar to vibrate. Such vibration changes the relationship between the work piece and the associated grinding wheels and as a consequence of the introduction of such variations in relationship inaccuracies appear in the surface being ground. The support bars included as a component of most conventional work rest support blade assemblies are generally rectangular in configuration and elongated and supported by opposite ends on opposite sides of the grinding wheels. This leaves the center of the support bar unsupported and subject to vertical and horizontal displacement in relation to its longitudinal axis as a result of the grinding forces imposed thereon. Accordingly, it is still another object of the invention to provide a work rest blade assembly incorporating a generally cylindrical work support bar which is supported over its entire length and which is tensioned on its surface next adjacent a work piece by imposition of a bending moment thereon so as to counteract any tendency of the support bar to move in relation to the work piece.

Still another object of the invention is to provide a generally cylindrical work support bar which is further tensioned by the imposition of rotary moments on opposite ends of the bar acting in opposite directions so as to twist the bar, thus further insuring the rigidity of the bar and its capability of withstanding vibrations without deleterious effect.

The invention possesses other objects and features of advantage, some of which with the foregoing, will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the work rest blade assembly of the invention includes a support body in the form of an elongated generally rectangular plate one long edge of which is formed to provide a crown centrally disposed along the plate edge between opposite ends thereof. Supported on the crowned edge of the support plate is a generally cylindrical work rest bar splined at opposite ends and secured to the crowned edge of the support blade by pair of front and rear clamps which simultaneously clamp the work rest bar to the crowned edge of the support plate, impose a bending moment on the work rest bar so that it conforms generally to the crown of the work rest plate, and simultaneously impose rotary moments in opposite directions at opposite ends of the work rest bar so as to impose torque or a twisting moment to the work rest bar. Means are provided associated with the clamps indexing with the splines on the ends of the work rest bar so that the work rest bar may be selectively rotated about its longitudinal axis so as to present a new unworn work surface on which a work piece may be supported, thus maintaining the relationship between the work rest bar and the associated grinding wheels.

BRIEF DESCRIPTION OF THE DRAWINGS

FIG. 5 is a side elevational view of one of the clamp plates of a pair of clamp plates adapted to engage the work rest bar at each end.

FIG. 6 is an end elevational view of the clamp plate illustrated in FIG. 5.

FIG. 7 is a side elevational view of the clamp plate that complements the clamp plate illustrated in FIG. 5 at each end of the bar.

FIG. 8 is an end elevational view of the clamp plate illustrated in FIG. 7.

FIG. 15 is a cross-sectional view through the bar and illustrating the location of wear spots on a fixed spline bar prior to its being turned end-for-end in the assembly. For clarity, the depth of the wear spots is exaggerated.

FIG. 16 is a view similar to FIG. 9 but showing the relationship of the wear spots to a work piece after the bar has been turned end-for-end. Again, the depth of the wear spots has been exaggerated.

DESCRIPTION OF THE PREFERRED EMBODIMENT

Figure 1:
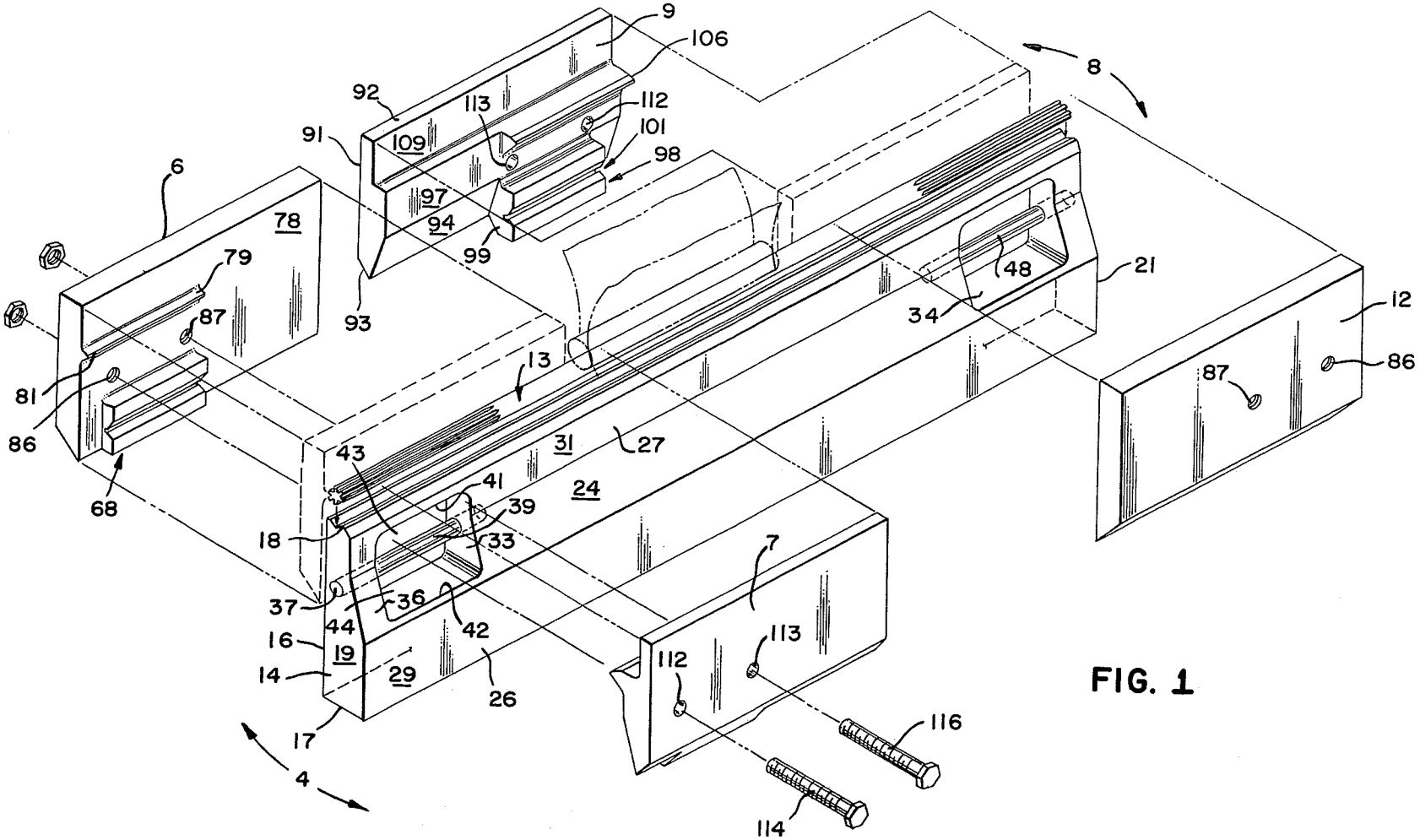
FIG. 1 is a fragmentary perspective view illustrating the work rest blade assembly in association with grinding and regulating wheels shown in broken lines, and two of the clamps shown laterally spaced to better illustrate their structure.

In terms of greater detail, the work rest blade assembly forming the subject matter of this invention is intended to replace almost all existing conventional work rest blades that utilize a generally rectangular bar as a work rest. Experience has shown that great savings can be made by eliminating the necessity of replacing conventional bars or buffing them down and readjusting them for continued use. Structurally, the work rest blade assembly of the invention comprises the assembly designated generally by the numeral 2 and shown apart from the other structure in FIG. 2. The assembly includes a support body or plate designated generally by the numeral 3, a first clamp assembly designated generally by the numeral 4, and including cooperating clamp plates 6 and 7, a second clamp assembly designated generally by the numeral 8 and including cooperating clamp plates 9 and 12, and a generally cylindrical work rest bar designated generally by the numeral 13.

Work Rest Body

Figure 4:
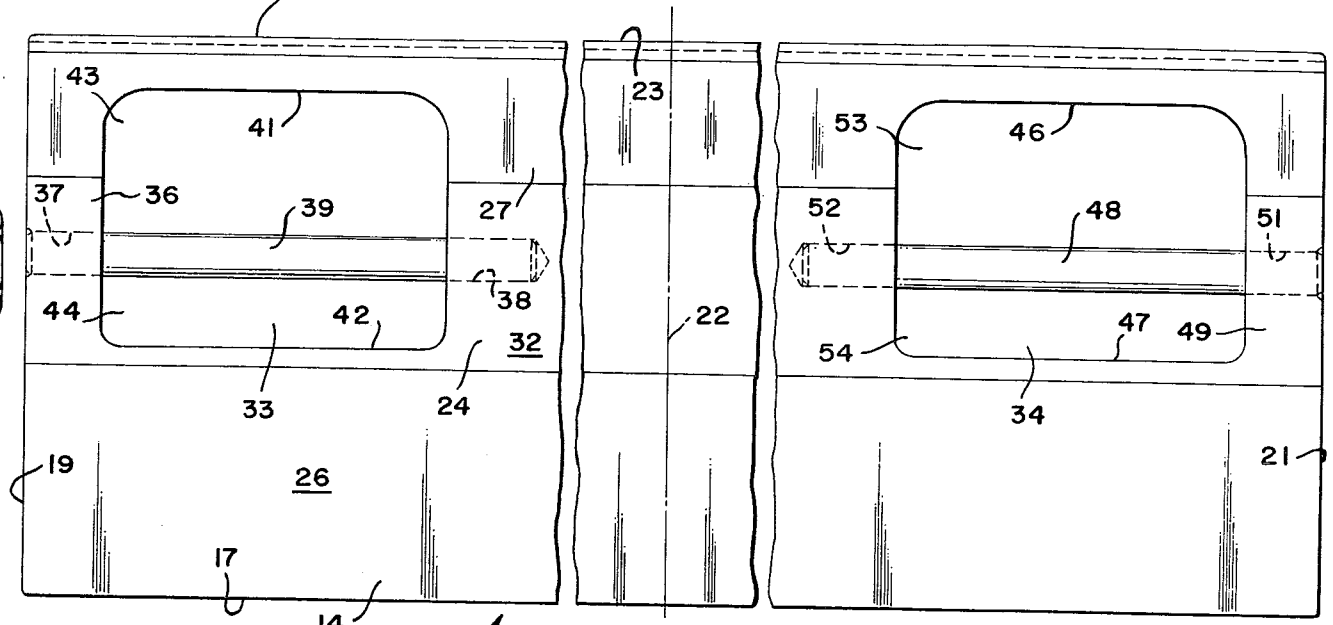
FIG. 4 is a side elevational view of the support blade or plate forming part of the work rest blade assembly and providing the crowned support on which the work rest bar is clamped. Portions are broken away to shorten the view.
Figure 2:
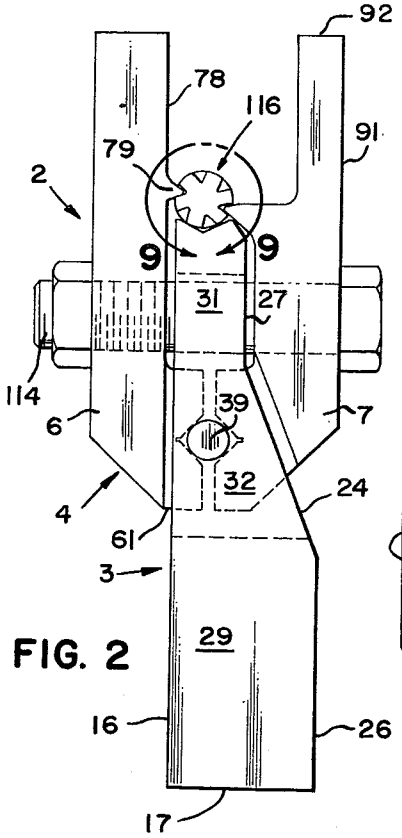
FIG. 2 is an end elevational view of the work rest blade assembly shown apart from the grinding and regulating wheels.

The support body or plate illustrated in perspective in FIG. 1 and in end and side elevations, respectively, in FIGS. 2 and 4, comprises an elongated plate 14 having a flat surface 16 thereon and being defined by a lower edge 17, an upper edge 18, and left and right ends 19 and 21 which are normal or perpendicular to the bottom edge 17. The support plate is preferably formed from tool steel and in one embodiment it has been found that the plate may be fabricated having a length of approximately nine inches, a width measured along the end edges 19 and 21 of approximately 0.850, while the width of the plate at the center line 22 is approximately 0.004 inch wider then at the ends of the plate, to thus provide a 0.004 inch crown 23 on the elongated edge 18, the crown merging smoothly from the high point at the center line 22 to the ends of the plate. The support plate is initially approximately one-half inch in thickness overall, and the surface of the plate opposite the surface 16 is provided with an inclined portion 24 which connects the flat surface 26 lying parallel to the surface 16 with the surface 27 which also lies parallel to the surface 16 but closer thereto by virtue of the edge portion of the plate defined by the surface 27 being thinned down to approximately one-fourth inch in thickness, or approximately one-half the thickness of the mounting portion of the support plate defined between the surfaces 16–26.

It should be understood that while certain dimensions have been indicated above, other dimensions for the support plate may be selected to increase or decrease the size thereof. The plate thus formed may be said to possess a work rest blade assembly mounting portion 29 defined as that portion of the plate between the bottom edge 17 and flat surfaces 16 and 26 and the commencement of the inclined surface 24. Additionally, adjacent the opposite edge 18 of the plate, it may be said that the plate provides a work rest bar support portion 31 defined by the upper edge 18, surface 16, and surface 27 up to the commencement of the incline surface 24. The portion of the plate encompassing the incline surface 24 and disposed between the work rest bar support portion 31 and the mounting portion 29 may be designated an anchor portion 32 as will hereinafter be explained.

Extending through the work support body are a pair of apertures 33 and 34. The apertures extend through the plate from one side thereof to the other and are generally rectangular in configuration, the aperture 33 being located generally adjacent top edge 18 and end edge 19, while the aperture 34 is aligned with the aperture 33 and is positioned generally adjacent the top edge 18 and the end edge 21 of the plate. With respect to the aperture 33, its position in relation to the upper edge 18 and end edge 19 provides a bearing portion 36 through which a bore 37 is provided extending axially of the elongated plate and being in exact alignment with a complementary bore 38 formed in the plate on the opposite side of the aperture as shown in FIG. 4. The bores 37 and 38 receive in a press fit relationship a hardened metal dowel 39 which extends lengthwise of the elongated plate generally parallel to its longitudinal axis and appropriately spaced between the top edge 41 of the aperture and the lower edge 42 thereof as shown, thus providing spaces 43 and 44 on opposite sides of the dowel 39 for purpose which will hereinafter be explained.

In like manner, the aperture 34 is provided with top and bottom edge surfaces 46 and 47 between which is disposed a hardened metal dowel 48 in axial alignment with the dowel 39. The dowel 48 is supported in the plate in like manner, the end thereof adjacent end edge 21 being press fitted into the mounting portion 49 of the plate which is provided with a bore 51 to accommodate the end of the dowel, while the opposite end of the dowel is press fitted into a bore 52 on the opposite side of the aperture. Since the apertures 33 and 34 are of equal size, and since the dowels 39 and 48 are positioned in axial alignment, it will be seen that spaces 53 and 54 are provided in aperture 34 on opposite sides of the hardened metal dowel 48.

Figure 9:
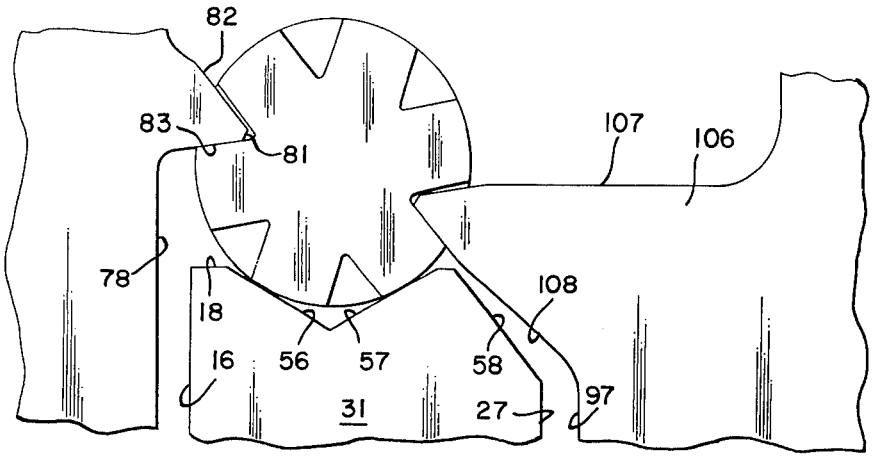
FIG. 9 is a fragmentary end view of the work rest bar, support plate and clamps illustrating the manner of engagement of the splines in the work rest bar by the teeth in the clamp plates.
Figure 14:
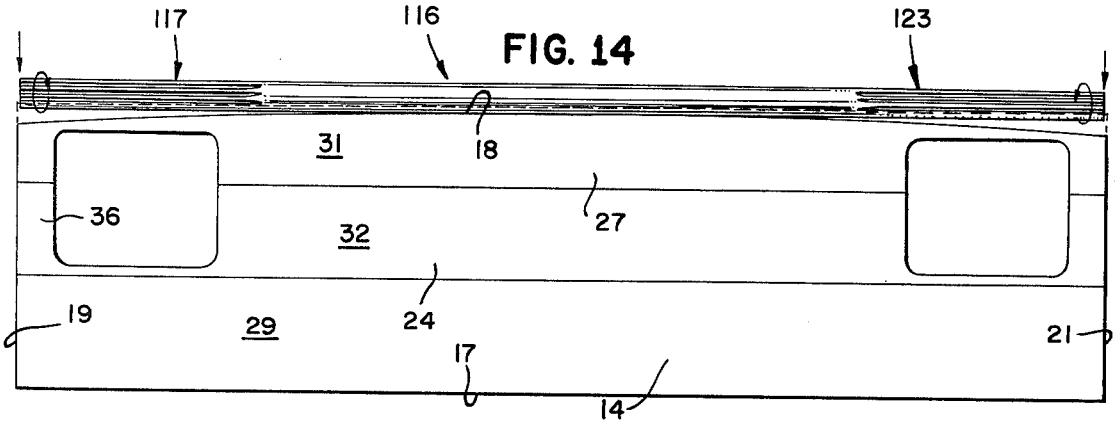
FIG. 14 is a schematic view illustrating the relationship between the work rest bar and the crowned edge of the support plate prior the the imposition of a clamping force by which a bending moment is imposed on the work rest bar to make it conform to the crown of the support plate to impose tension therein while simultaneously oppositely directed rotary moments are imposed on opposite ends of the bar to effect a twisting action thereof.

Referring to FIG. 9, to accommodate a work rest bar as will hereinafter be explained in greater detail, the edge 18 of the work support plate or body, in addition to being crowned as previously explained in connection with FIGS. 4 and 14, is milled to provide two longitudinally extending flat surfaces 56 and 57 angularly disposed with respect to each other and lying in planes that intersect at an angle of approximately 120°. The inclined surface 56 lies next adjacent the side surface 16 of the support plate, and cooperates with the elongated angularly disposed surface 57 to define an elongated groove extending the full length of the support plate. It is important to note that the point of intersection of the planes that contain the elongated inclined surfaces 56 and 57 is disposed adjacent the side surface 16 of the plate, being offset toward that surface from a vertical plane extending through the longitudinal axis of the dowel pins 39 and 48. The importance of this relationship will be explained in greater detail hereinafter. As shown in FIG. 9, the corner of the plate forming the intersection of upper edge 18 and surface 27 is relieved by an elongated chamfer to produce an elongated flat surface 58 (FIG. 9) extending the full length of the support plate and being angularly disposed to both the surface 27 and the elongated inclined surface 57. The support plate or body thus described cooperates with the two pairs of clamp assemblies designated generally by the numeral 4 (FIG. 2) to clamp the work rest bar to the top of the support plate so it lies rigidly trapped in the groove formed by the surfaces 56 and 57, is slightly flexed longitudinally and twisted slightly to increase its rigidity. The clamp assembly will now be described in greater detail.

Work Rest Bar Clamp Assembly

As previously stated, the pair of clamp assemblies are designated generally by the numeral 4, and each pair includes a clamp plate 6 and a clamp plate 7 as shown in FIGS. 2, and 5–8. Referring first to the clamp plate 6 as seen in FIGS. 5 and 6, the plate is generally rectangular in configuration, having a lower edge 61, a top edge 62 and end edges 63 and 64 as shown. The lower edge 61 is chamfered over its entire length to provide an inclined surface 66 the bottom edge of which merges with the lower edge 61 while the upper edge of the incline surface 66 merges with the outboard side or surface 67 of the plate which is flat as shown.

Formed adjacent the lower edge 61 of the plate is an anchor jaw designated generally by the numeral 68 and including a pad 69 in the surface 71 of which is formed a groove designated generally by the numeral 72 formed by inclined machined surfaces 73 and 74. The pad 69 is elongated in its configuration as is the groove 72 formed therein, with one end 76 of the pad being spaced from the associated end edge 64 of the plate. The opposite end 77 of the pad extends to almost the midpoint of the plate to thus form a projection from the inboard surface 78 of the plate. Spaced from the upper edge 62 of the plate is an elongated tooth or spline 79 which projects from the surface 78 in the same direction as the pad 69, and which is provided with an apex 81 defining the meeting point or interception of spline surfaces 82 on the top and 83 on the bottom (FIG. 9). For reasons which will hereinafter appear, the included angle between surfaces 82 and 83 is 60° while the tooth surface 83 is offset from a plane perpendicular to the surface 78 by the amount of 10°, thus causing the spline surface 83 to lie at approximately 120° to the surface 78. This angular relationship of the surfaces 82 and 83 with the surface 78 of the plate is important for reasons which will hereinafter be apparent. The spline 79 extends for approximately one-half the length of the clamp plate 6, terminating in an end 84 as shown. Disposed between the spline 79 and the pad 69 are a pair of spaced bores 86 and 87, each of the bores being tapped to provide threads therein.

The complementary plate 7 (FIGS. 2, 7 and 8) of the pair of clamp plates 4 is preferably the same length as the clamp plate 6, and is provided with an outboard surface 91 interscepting the top edge 92 and a bottom edge 93 beveled to provide angularly disposed surfaces 94 and 96. The surface 94 of the plate merges with inboard surface 97 from which projects the jaw assembly designated generally by the numeral 98 and formed by a projecting pad 99 having a groove 101 formed therein by angularly disposed surfaces 102 and 103. The pad is provided with a front face or surface 104 that lies parallel to the outboard surface 91 and inboard surface 97, and the groove 101 is symmetrically formed with respect to a longitudinally extending plane that lies perpendicular to the surface 104. Comparing the groove 101 in plate 7 with the groove 72 in plate 6, it will be noted that in final assembly the plates 6 and 7 face each other so that the pads 69 and 99 project toward each other, the grooves 72 and 101 being oppositely disposed and symmetrical with respect to a common plane. Formed on and projecting from the inboard surface 97 is a spline 106 having a top surface 107 and a lower surface 108, the surfaces 107 and 108 being angularly disposed with respect to each other and with respect to the associated inboard surfaces 97 and 109. It is noted that the surface 109 lies recessed below the surface 97 as shown.

Extending through the plate from the inboard surface 97 through the outboard surface 91 are a pair of spaced apertures 112 and 113, the apertures lying axially disposed with respect to the plate in which they are formed and lying in axial alignment with the apertures 86 and 87 of plate 6 when the clamp plates are assembled to form a clamp assembly. Appropriate cap screws 114 and 116 extend through apertures 112 and 113 to threadably engage the threaded apertures 86 and 87 in the complementary clamp plate 6 in a manner and for a purpose which will hereinafter be explained.

Work Rest Bar

Figure 10:
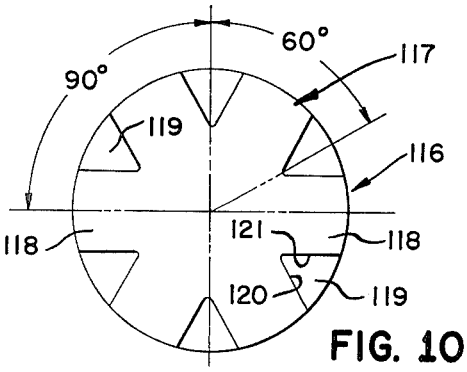
FIG. 10 is an end elevational view of one end of the work rest bar, showing the relationship of the splines in that end with a horizontal plane.

As indicated above, most conventional centerless grinders utilize a work rest blade assembly that incorporates a generally rectangular bar. In most instances, the work surface of the work rest bar is inclined to the horizontal so that a cylindrical work piece carried on the inclined surface will have a tendency to fall into the bight formed between the revolving surface of the grinding wheel and the inclined support surface of the work rest bar. The work rest bar forming the subject matter of this invention comprises a generally cylindrical bar 116 having an overall length equal to the length of the support plae 14 (FIG. 14) and adapted to rest and be cradled in the groove formed by the surfaces 56 and 57 in the top crowned edge 18 of that plate (FIG. 9). One end portion 117 of the generally cylindrical work rest bar is provided with a multiplicity of splines 118, the splines being defined by grooves 119 formed in the surface of the bar and extending longitudinally along the bar from each end for the length of the portion 117. Each of the grooves defining adjacent sides of adjacent splines is formed with sixty degree side walls 120 and 121 (FIG. 10), the grooves being equally spaced about the periphery of the cylindrical bar.

Figure 3:
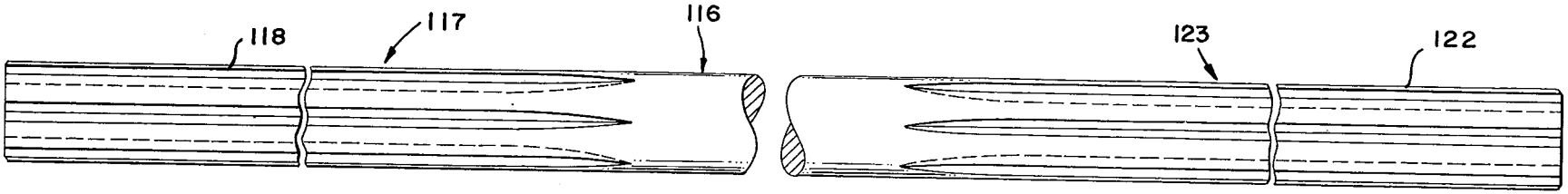
FIG. 3 is a plan view of the work rest bar, a portion being broken away to reduce its length.
Figure 11:
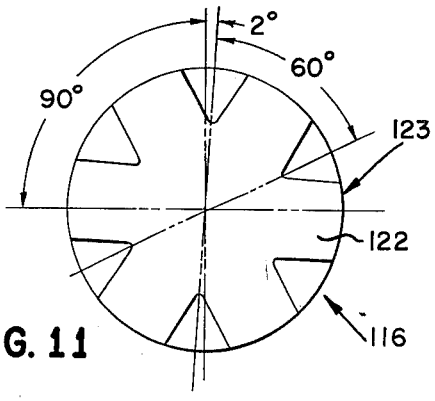
FIG. 11 is an end elevational view of the opposite end of the work rest bar, showing that the splines at this end of the bar are offset by about 2° in relation to the splines at the opposite end of the bar as shown in FIG. 10.
Figure 12:
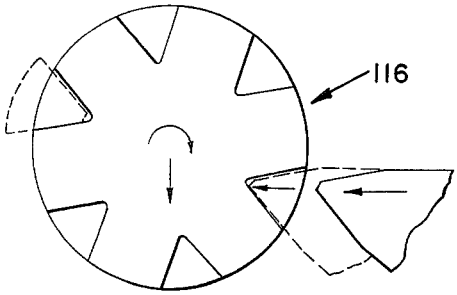
FIG. 12 is a schematic view illustrating an end view of the work rest bar and the relationship between the groove between to splines and the clamp tooth that engages it to impose a clockwise rotary moment on the bar.
Figure 13:
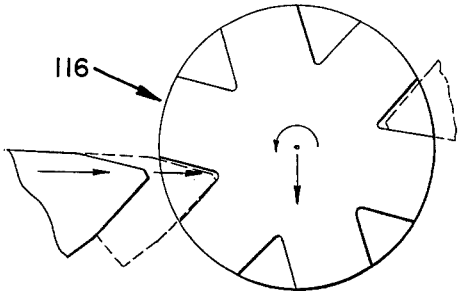
FIG. 13 is a schematic view illustrating the opposite end of the work rest bar and the relationship between the groove between two splines and the clamp tooth that engages it to impose a counter-clockwise rotary moment on the bar.

It is important to note that with respect to the splines 122 (FIG. 11) formed in the end portion 123 of the cylindrical bar (FIG. 3), these splines are offset circumferentially approximately 2° from the splines 118 formed in the opposite end portion 117. It is the presence of this 2° offset in the positions of the splines that facilitates the imposition of a rotary twisting moment on each end of the splined shaft simultaneous with a bending moment thereon to impose two different types of stress and strain in the work rest bar to thus effectively rigidify the work rest bar.

General Assembly

As viewed in FIGS. 1 and 2, the work rest bar 116 is adapted to lie nestled in the groove formed by surfaces 56 and 57 in the work support plate 14. To retain the work rest bar in this position and to impose a bending moment thereon and rotary moments in opposite directions on opposite ends of the work rest bar, the two pairs of clamp assemblies are mounted on the support plate 14 so that the jaw assemblies 68 and 98 of each clamp assembly project through the associated apertures 33 and 34 with the grooves 72 and 101 engaging metal dowels 39 and 48. With the clamp plates 6 and 7 thus arranged to engage the dowel from opposite sides thereof as viewed in FIGS. 1 and 2, the work rest bar 116 is laid in the groove formed in the top edge 18 of the support plate, and the splines 79 and 106 projecting from the surfaces of the two pairs of clamp plates are caused to engage the work rest bar from opposite sides thereof and at opposite ends thereof. The engagement of the splines 79 and 106 with the end portion 117 of the work rest bar is such that the spline 79 engages one of the grooves defining adjacent sides of adjacent splines at a point on one side of the central axis of the work rest bar, while the spline 106 engages a complementary groove 180° diametrically opposed to the groove engaged by the spline 79, but positioned on the opposite side of the longitudinal central axis of the work rest bar.

With this relationship of the splines 79 and 106 with the diametrically opposed grooves on opposite sides of the longitudinal central axis of the work rest bar, any movement of the plates 6 and 7 toward each other as would occur by tightening the cap screws 114 and 116 extending through apertures 112 and 113 and engaging threaded apertures 86 and 87 in plate 6, will cause the engaged end of the work rest bar to be displaced downwardly against the upper surface 118 of the support plate, which as previously discussed, is provided with a crown 23.

Since the opposite end of the work rest bar is captured by a complementary pair of clamp plates positioned in opposite orientation to the orientation of the plates 6 and 7, the opposite end of the work rest bar will also be pulled downwardly toward the associated surface of the support plate with the result that a bending moment is placed on the bar extending over its entire length and causing it to conform to the crowned upper edge 18 of the support plate. Such bending moment effects a transverse displacement of the work rest bar of approximately 0.004 of an inch from the midpoint of the support plate to each end thereof.

It should be understood that because the clamp assembly at the opposite end of the work rest piece is reversed in its orientation, one of the clamp assemblies will cause rotation of the associated end of the work rest bar in one direction, while the opposite set of clamp plates will cause rotary displacement of the associated end of the work rest bar in the opposite direction, thus imposing torque or a twisting moment on the bar so as to "load" the bar and thus rigidify it.

Another interesting and surprising result of the use of the work rest bar of the invention is that because of the 2° offset of the splines on opposite ends, the bar may be turned end-for-end so as to double the number of wear surfaces that may be secured from a single bar as illustrated in FIGS. 15 and 16. Thus, as compared with a conventional work rest bar, the cylindrical splined work rest bar of the invention may be used as much as twelve or more times longer than the conventional bar without the need of "dressing" the work rest bar, and with complete assurance that close dimensional tolerances will be maintained.

Having thus described the invention, what is claimed to be novel and desired to be covered by United States letters patent is as follows:

1. The method of rigidifying the work rest blade of a centerless grinder comprising the steps of:

(a) supporting the work rest blade on the crowned edge of an elongated support plate so that the longitudinal axis of the work rest blade extends in the same direction as the support plate;

(b) imposing a downward force on opposite ends of the work rest blade to make it conform to the crown of the supporting edge of the support plate; and (c) simultaneously imposing rotary moments of force on opposite ends of said work rest blade acting in opposite directions whereby there is a tendency to twist the work rest blade to maintain said blade in said rigidified condition.

2. The method according to claim 1, in which said rotary moments of force are imposed on the work rest blade while maintaining the axial alignment of the central axis of the work rest blade with the elongated edge on which the work rest blade is supported.

* * * * *

UNITED STATES PATENT OFFICE

CERTIFICATE OF CORRECTION

Patent No. 4,086,065 Dated April 25, 1978

Inventor(s) Van Q. Maxey

It is certified that error appears in the above-identified patent and that said Letters Patent are hereby corrected as shown below:

Column 3, Line 16 "to" should read --two--;

Line 26 "the", first occurence, should read --to--.

Column 4, Line 6 "0.850" should read --0.850 inch--.

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*